US007140301B1

(12) United States Patent
O'Dwyer

(10) Patent No.: US 7,140,301 B1
(45) Date of Patent: Nov. 28, 2006

(54) FORMING TEMPORARY AIRBORNE IMAGES

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 246 days.

(21) Appl. No.: 10/130,064

(22) PCT Filed: Nov. 17, 2000

(86) PCT No.: PCT/AU00/01404

§ 371 (c)(1),
(2), (4) Date: Oct. 30, 2002

(87) PCT Pub. No.: WO01/36900

PCT Pub. Date: May 25, 2001

(30) Foreign Application Priority Data

Nov. 18, 1999 (AU) ..... PQ 4131

(51) Int. Cl.
*F42B 4/04* (2006.01)

(52) U.S. Cl. ..... 102/361; 102/335

(58) Field of Classification Search ..... 89/1.41, 89/28.05; 102/217, 335, 346, 361
See application file for complete search history.

(56) References Cited

U.S. PATENT DOCUMENTS 2,095,490 A * 10/1937 Decker ..... 89/1.819
2,103,936 A * 12/1937 Decker ..... 102/357
2,938,430 A * 5/1960 Pion ..... 89/1.808
3,212,402 A * 10/1965 Biehl et al. ..... 89/1.801
3,855,899 A * 12/1974 Billottet et al. ..... 89/47
4,604,939 A * 8/1986 Hoffmeister et al. ..... 89/1.816
4,681,017 A * 7/1987 Fischer et al. ..... 89/29
4,709,615 A 12/1987 Field
5,339,741 A 8/1994 Craven et al.
5,526,750 A 6/1996 Poor et al.
5,883,329 A * 3/1999 O'Dwyer ..... 102/217

FOREIGN PATENT DOCUMENTS

| | | |
|---|---|---|
| AU | 43323/85 | 6/1985 |
| DE | 196 07 490 | 9/1997 |
| EP | 0 124 183 | 11/1984 |
| GB | 2 315 560 A | 2/1998 |
| GB | 2 327 116 | 1/1999 |
| GB | 2 330 896 | 5/1999 |
| WO | WO 94/20809 | 9/1994 |
| WO | WO 00/62004 | 10/2000 |
| WO | WO0062005 | 10/2000 |
| WO | WO 01/90680 A1 | 11/2001 |

* cited by examiner

*Primary Examiner*—Troy Chambers
(74) *Attorney, Agent, or Firm*—Finnegan, Henderson, Farabow, Garrett & Dunner, L.L.P.

(57) ABSTRACT

A temporary airborne image is formed by the steps of arranging a plurality of projectiles in each of one or more barrel assemblies wherein the projectiles include image forming matter; firing a predetermined number of the plurality of projectiles from selected barrel assemblies; and deploying the image forming matter to form a temporary airborne image.

3 Claims, 3 Drawing Sheets

FORMING TEMPORARY AIRBORNE IMAGES

BACKGROUND OF THE INVENTION

1. Field of the Invention

The present invention relates to forming temporary airborne images. In particular, this invention relates to a method of forming temporary airborne images such as for entertainment purposes or advertising purposes.

2. Description of the Related Art

Temporary airborne images have been formed using pyrotechnic displays for entertainment purposes and have become very popular at national and international events with organisations spending large sums of money in order to provide new and/or interesting visual displays. In order to provide individuality, such displays are generally custom made or designed to achieve a desired display. Generally sophisticated displays are very expensive to produce.

SUMMARY OF THE INVENTION

We have now found a method of forming a temporary airborne image that permits the formation of a selected recognisable image. Accordingly the present invention provides a method of forming a temporary airborne image including the steps of arranging a plurality of projectiles in each of one or more barrel assemblies wherein said projectiles include image forming matter, firing a predetermined number of the plurality of projectiles from selected barrel assemblies, and deploying the image forming matter to form a temporary airborne image.

This invention may utilise barrel assemblies capable of firing a controlled rapid fire sequence of mortar like projectiles and being of the general type described and/or illustrated in earlier International Patent Applications of the inventor, such as PCT/AU94/00124, PCT/AU00/00296 and PCT/AU00/00297. In at least some of these earlier applications, including the earliest filed International Application No. PCT/AU94/00124, there are described arrangements for grouping barrels each containing a plurality of projectiles so that a large number of projectiles can be fired in rapid-fire succession. In such arrangements barrels may be formed from a cylindrical shell having a plurality of projectiles axially disposed within the shell for operative sealing engagement with the bore of the shell and discrete propellant charges for propelling respective projectiles.

Suitably the barrel assemblies may be of the low pressure type which fire grenade-like projectiles although high muzzle pressure barrel assemblies may be used. Respective barrel assemblies may be loaded with different projectiles and the barrel assemblies may have different size bores for accommodating different size projectiles.

Suitably each projectile includes a trailing collar captively mounted to the projectile body and when stored in the barrel, extends rearwardly to wedge against the nose portion of a trailing projectile body. Suitably the wedging action is provided by a shallow wedge whereby, in use, the trailing end of the collar is expanded into operative sealing engagement with the barrel.

The trailing collar may be mounted for limited axial movement relative to the projectile body and the leading end of the collar formed with an annular sealing face engageable with a complementary face formed on the projectile body whereby rearward movement of the projectile body resulting from the reaction of propellant gases thereon forces the its complementary face into sealing engagement with the annular sealing face at the leading end of the collar.

The complementary face and the annular sealing face may extend substantially radially and be formed with complementary sealing features thereon. However it is preferred that these faces are complementary part-conical sealing faces which wedge into tight sealing engagement with one another. The leading end part may also be expandable into operative sealing engagement with the barrel. Suitably however the wedging between the part-conical faces are relatively steep faces whereby the leading end of the collar is not expanded into operative sealing engagement with the barrel by the wedging action.

Preferably, each projectile is associated with a high pressure propellant chamber which exhausts to respective low pressure propulsion chambers formed between the adjacent projectiles for efficient low muzzle velocity operation. The high pressure propellant chambers may be formed integrally with the projectile body or the trailing collar or be provided at the exterior of the barrel to communicate therewith through ports provided through the barrel wall.

The image forming matter may include, for example, explosive matter, incendiary matter, incandescent or luminous matter or other matter to provide a highly visible temporary image.

Alternatively, the image forming matter may include smoke, gas, particles or sheets or strips, such as in the nature of chaff, or other material capable of being dispersed to form, an image. The image forming matter may also include means for slowing its descent from its dispersed position, such as a parachute and the like.

The projectiles are arranged in the barrel assemblies such that once fired and the image forming matter deployed, the desired temporary airborne image is formed. Projectiles containing different image forming matter, either differing in colour or form, may be sequentially loaded into each barrel assembly.

The projectiles may be electronically fired at an infinitely variable frequency up to the maximum rate of fire. For firing from a barrel assembly according to an aspect of this invention and arranged for low pressure, low muzzle velocity, the rate of firing is limited by the time taken for each projectile to leave the barrel and by the time necessary for the gas pressure in the barrel to drop sufficiently to enable the firing of the next projectile.

The predetermined number of the plurality of projectiles may be fired from selected barrel assemblies at a rate selected to obtain the desired temporary airborne image. The firing of the projectiles may preferably be controlled by a microprocessor to permit the accurate firing of the projectiles at the selected rate.

The image forming matter may be deployed, for example, by explosive means, by stored energy or by separation of separable parts of the projectile to expose the image forming matter or by any other suitable dispersing means.

A timing mechanism to control the deployment may be of any suitable type and may be clock based or based on a flight characteristics of the projectile such as the number of spins of a projectile fired from a rifled barrel or it may be based on the ambient atmospheric conditions at the selected display position.

The image may be formed as an upright image or a horizontal image and may include either or both image forming matter which leaves a visible trail during descent and image forming matter which does not leave a visible trail during descent. The former may be used to provide a coloured background or a stripe or the like while the latter may provide feature within the image such as a bright star-like image.

The projectiles may be configured to disperse the image forming matter at a set time from firing and the firing may be controlled for trajectory or barrel exit velocity so that upon dispersal of the image forming matter the desired displayed is achieved. Alternatively a barrel assembly may contain respective projectiles adapted to produce different image effects and the desired image may be controlled by selectively firing the projectiles to assemble an in-air compilation of different image effects to achieve the desired image.

For the purposes of fireworks and for forming recognisable or abstract airborne images for entertainment purposes the projectiles could be set in the barrel assembly to be fired sequentially to produce a set result. Alternatively a bank of barrel assemblies may be utilised containing respective colour pyrotechnic matter which may be selectively fired and, if desired at a desired trajectory or timing, the barrel assemblies being controlled remotely such as from a computer keyboard and screen which may show a preview of the image to be formed and enabling an operator to "print" a desired or random airborne pattern. The image may be a two or three dimensional image as desired. Different banks of barrel assemblies may be utilised and/or placed so as to form a respective unique portion of the image being formed.

A direction control means may be provided in a bank of barrel assemblies and may permit uniform pivoting of the barrel assemblies so that the inclination of the axes of the barrel assemblies relative to the axis of a pod containing the bank of barrel assemblies may be selectively varied to enable a target position relative to the pod to be varied. The direction control means may permit individual pivoting of each barrel assembly so that the inclination of each barrel axis relative to a pod axis may be individually varied to enable a target position or individual target positions relative to the pod to be varied. Such individual control may be associated with individual firing control of each barrel assembly if desired.

The direction control means may alternatively permit a controlled splaying of all barrel assemblies so that the area covered at the target zone may be selectively varied. Alternatively the direction control means may permit all or some of the above variations to be achieved individually or collectively as required.

The pod housing may be of any suitably configuration and may taper towards its base to enable barrel assemblies to be supported in a splayed attitude. The support means may be fold out legs which may be adjustable if desired. In one form the pod has a rectangular pod housing for economy or ease of storage and/or transport and the base thereof constitutes the support means.

A pod of barrel assemblies may be fired from a marine platform. The pod may also be fired from an aircraft, or from a number of aircraft flying in formation and if desired, with the firing coordinated between the aircraft by a suitable electronic link.

BRIEF DESCRIPTION OF THE DRAWINGS

In order that this invention may be more readily understood and put into practical effect, reference will now be made to the accompanying drawings which illustrate a typical embodiment of the invention and wherein.

DETAILED DESCRIPTION OF THE INVENTION

Figure 1:
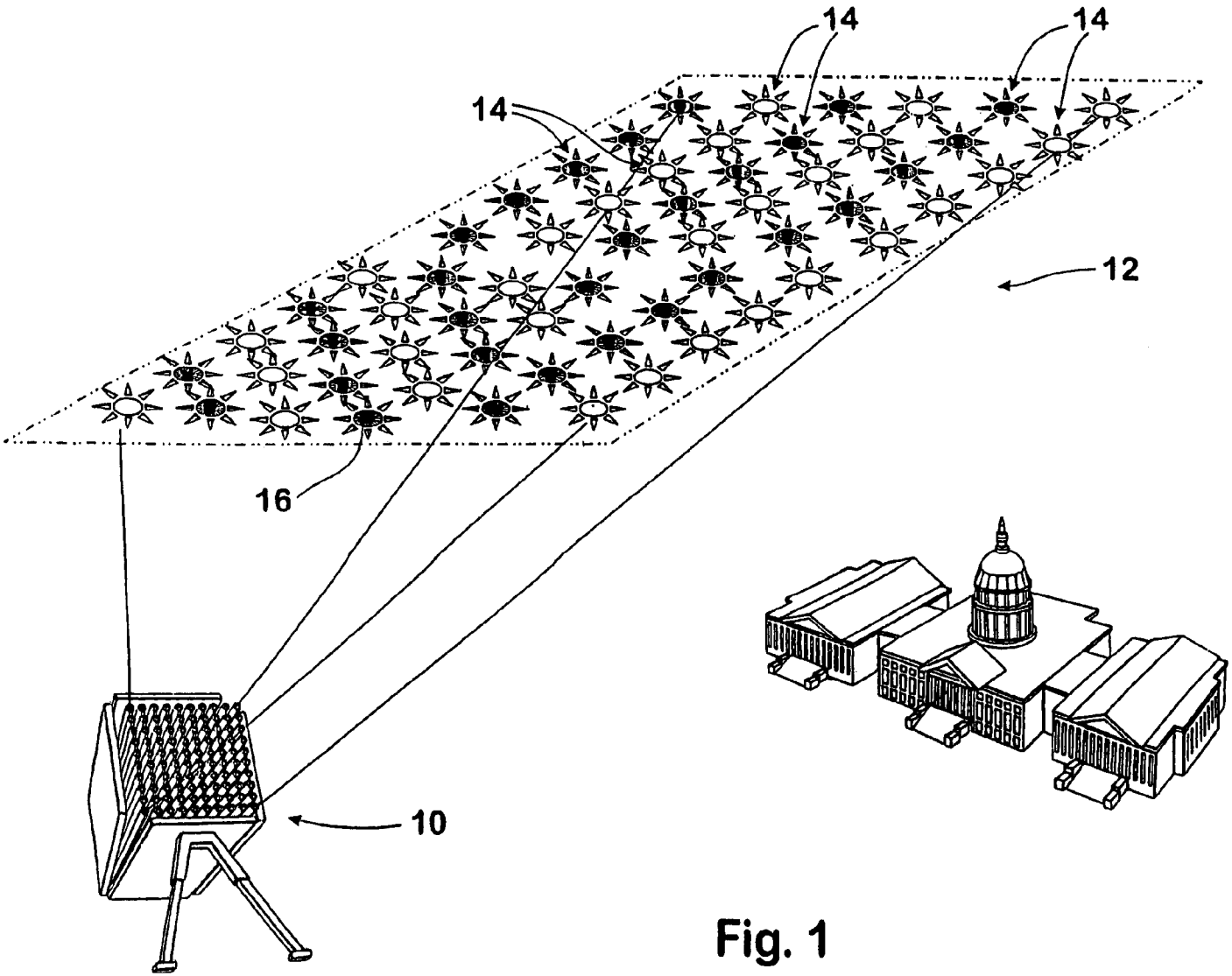
FIG. 1 illustrates a typical image being formed in accordance with the invention.

Referring to FIG. 1 of the drawings it will be seen that a group of barrel assemblies 10 of the type described loaded with mortar-like projectiles which explode mid air at a set distance and trajectory from the barrel assemblies will provide a thermal image of a selected or random configuration. The formed image 12 in FIG. 1 is fired from the barrel assemblies 10 and includes alternate clusters of respective colours at 14 which simulate or momentarily provide visible overhead stripes as well as bright burning individually discernible image portions 16 which resemble stars so that, for example, a very large flag may be momentarily printed in the sky above a festive area. The print may be formed progressively from one point or it may be formed complete in an instant.

The barrel assemblies from which the projectiles are fired may be supported on the ground or they may be supported on a watercraft or aircraft. The barrel assemblies can be controlled for selective discharge of the projectiles in respect of sequence and trajectory, whereby a variety of shapes or images may be selectively formed as desired.

Figure 2:
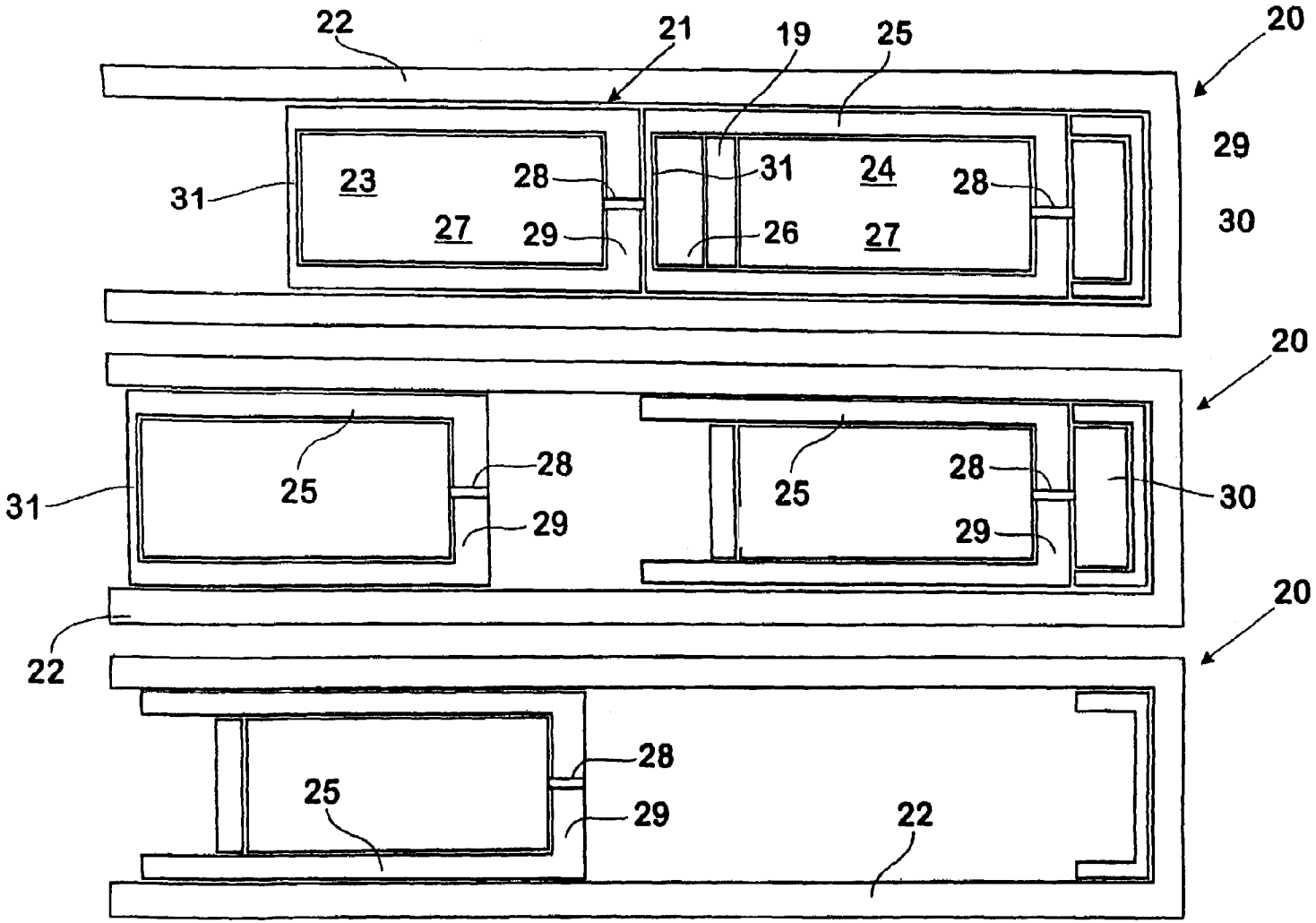
FIG. 2 is a diagrammatic side view of a barrel assembly not being of the type described but suitable for firing projectiles for forming a temporary airborne image.

Referring to FIG. 2 it will be seen that an alternate barrel assembly 20 may include a plurality of projectiles 21 arranged in an axial abutting relationship in a barrel 22, the projectiles including a leading projectile 23 and following projectiles 24, only one of which is illustrated. Each following projectile 24 includes an outer case 25 of a suitable plastic or other suitable material and supporting therein a leading propellant charge 26 for propelling the projectile preceding it in the barrel, a separator disc 19 separating the leading propellant charge from the remainder of the projectile interior which supports a pyrotechnic charge 27 which burns/explodes in the atmosphere to provide a respective portion of the airborne image to be created.

A controlled rate burn link 28 extends through the back wall 29 of the case 25. This receives its ignition from the burning propellant as it exits the barrel 22 and detonates the pyrotechnic material when it burns fully through the back wall 29. The base of the barrel 22 supports a separate propellant charge 30 for propelling the last of the following projectiles 24 from the barrel 22.

The initiation means for detonating the propellant charges 26 and 30 may be via an external barrel mounted primer or be achieved electrically through spaced annular contacts extending about the case 25 and contacting respective sets of contacts in the barrel 22. As illustrated the front wall 31 of the case 25 is relatively thin so that it will be easily ruptured by detonation of the propellant 26 for propelling the preceding projectile 21 from the barrel. In this action the separator 19 will prevent back burning into the pyrotechnic charge 27 and expansion of the cylindrical side wall 32 into tight engagement with the barrel, thus preventing bypass about the projectile containing the propellant being detonated to a trailing projectile 24.

Figure 3:
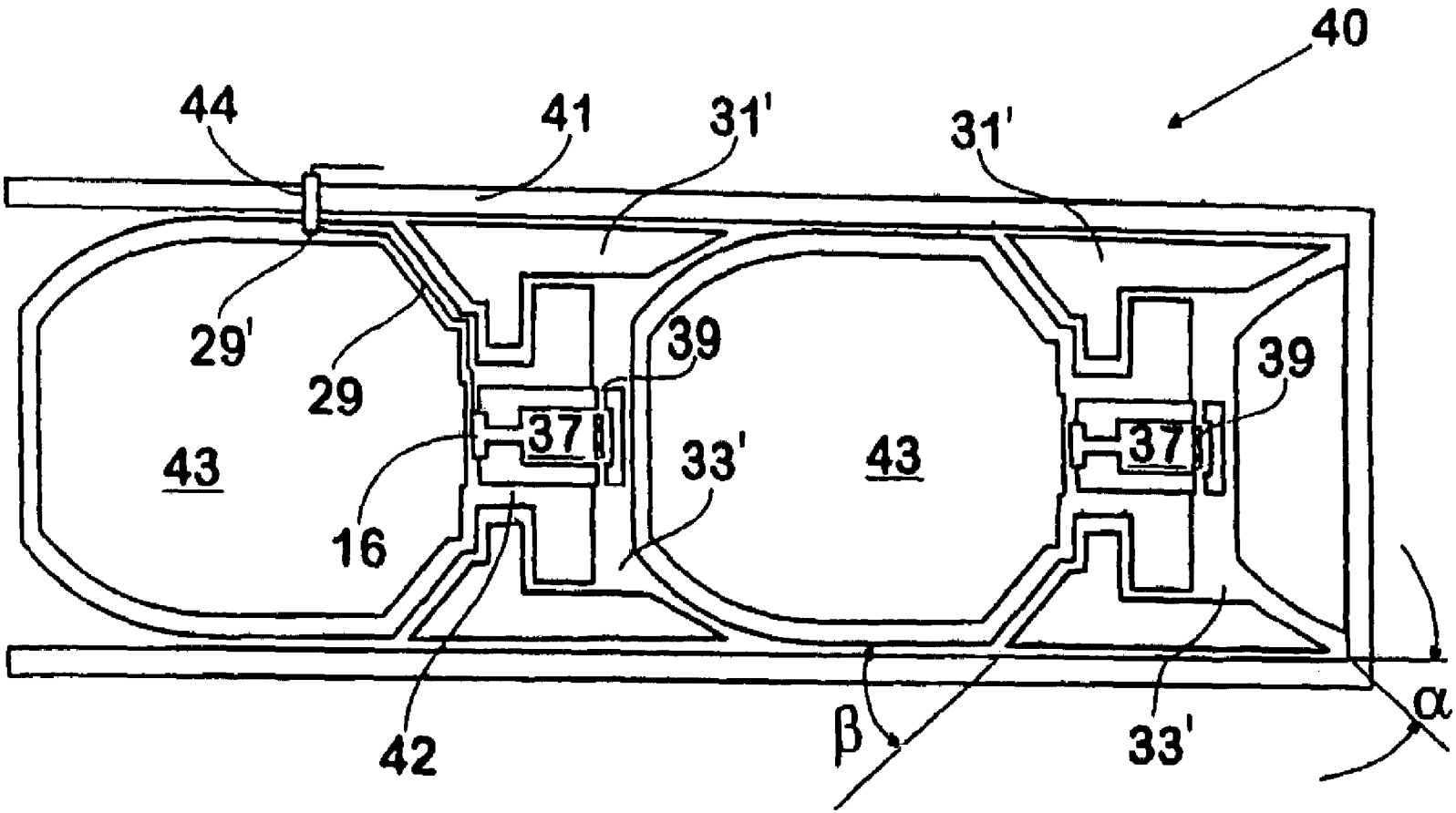
FIG. 3 diagrammatically illustrates typical barrel assemblies for use in this invention.

The barrel assembly 40 illustrated in FIG. 3 includes wedge sealing angles $\alpha$ and $\beta$ between the trailing sleeve 31' and the projectile body, here in the form of a grenade housing 42. In this embodiment which is more suited to low pressure low muzzle velocity applications, the opposed ends of the trailing sleeve 31' formed by the sealing angles α and β of between 30° and 55° are sufficiently blunt as to resist outward splaying into sealing engagement with the barrel under the influence of propellant pressures. Typically these would be in the order of 3000 psi to 5,000 psi with muzzle velocities of about 70 m/sec and 250 m/sec respectively.

It will be seen that the bulbous nose part 43 of the projectile body 42 is hollow for carrying image forming matter. The propellant 37 in the high pressure chamber 46 is selectively ignited to expel high pressure gases through the trailing ports 39 into the low pressure chamber 33' by a detonator 16.

The detonator or primer is triggered through an electrical circuit which uses the projectile column as one part of the circuit, the barrel 41 being made of insulating materal or so lined and with the circuit completed by an imbeded insulated wire 29 leading from the primer 16 to a contact 29' on the projectile surface which is aligned when loaded, with a complementary contact 44 supported in the barrel 41.

Alignment of the contacts 29', 44 can be achieved in a barrel and projectile located by rifling grooves during the loading process. In a non rifled design, the use of an annular contact in the barrel wall can achieve a similar result.

It will of course be realised that the foregoing description has been given only by way of illustrative example of this invention and that all such and other modifications and variations thereto as would be apparent to persons skilled in the art are deemed to fall within the broad scope and ambit of this invention as is herein set forth in the accompanying claims.

What is claimed is:

1. A method of forming a temporary airborne image as a display for entertainment or advertisement to human observers, including the steps of:

selecting one of a variety of images to form the display, providing barrel assemblies each including multiple firework projectiles containing image forming matter, deploying a pod containing a bank of barrel assemblies, setting a distance, or time and trajectory from the barrels at which said projectiles will disperse the image forming matter mid air, and firing the projectiles from the bank of barrel assemblies to form said selected image.

2. A method according to claim 1, further including a step of individually pivoting each barrel assembly to adjust the inclination of the barrel assembly with respect to the axis of the pod, whereby the trajectory of each projectile is adjusted.

3. A method according to claim 1, further including a step of providing projectiles adapted to provide different image forming effects, and firing said projectiles from different barrel assemblies.

* * * * *